United States Patent [19]

Blyth et al.

[11] Patent Number: 4,619,853

[45] Date of Patent: Oct. 28, 1986

[54] EASY-CLEAN CARPETS WHICH ARE STAIN RESISTANT AND WATER IMPERVIOUS

[75] Inventors: Randolph C. Blyth, Gulf Breeze; Pompelio A. Ucci; George R. McLellan, both of Pensacola, all of Fla.

[73] Assignee: Monsanto Company, St. Louis, Mo.

[21] Appl. No.: 739,391

[22] Filed: May 30, 1985

Related U.S. Application Data

[63] Continuation of Ser. No. 546,114, Dec. 21, 1983, abandoned.

[51] Int. Cl.[4] ..... B32B 3/02; B32B 33/00

[52] U.S. Cl. ..... 428/95; 428/96; 428/97

[58] Field of Search ..... 428/95, 96, 97

[56] References Cited

U.S. PATENT DOCUMENTS

| | | | |
|---|---|---|---|
| 3,118,723 | 1/1964 | Harding | 8/4 |
| 3,178,309 | 4/1965 | Harding | 117/139.5 |
| 3,322,488 | 5/1967 | Freeman | 8/115.5 |
| 3,663,157 | 5/1972 | Gilgien et al. | 8/65 |
| 3,765,839 | 10/1973 | Mueller et al. | 8/65 |
| 3,849,162 | 11/1974 | Mueller et al. | 117/33.5 |
| 4,112,161 | 9/1978 | Sorrells | 428/97 |
| 4,210,691 | 7/1980 | Bolgiano | 428/97 |
| 4,295,852 | 10/1981 | Walz et al. | 8/560 |
| 4,302,202 | 11/1981 | Sumner et al. | 8/455 |
| 4,325,890 | 4/1982 | Reitz et al. | 260/512 |

*Primary Examiner*—Marion C. McCamish
*Attorney, Agent, or Firm*—John W. Whisler

[57] ABSTRACT

Carpets having a primary backing and a pile consisting essentially of polyamide fibers stitched into the primary backing are described. The fibers are characterized in being stain resistant and the backing is characterized in being impervious to water. The carpet is easy to maintain since its fibers are stain resistant and water can be used to clean the carpet without fear of the water penetrating the backing and being absorbed by the padding, a situation which leads to rotting of the carpet and wooden floors.

4 Claims, No Drawings

EASY-CLEAN CARPETS WHICH ARE STAIN RESISTANT AND WATER IMPERVIOUS

This is a continuation of application Ser. No. 546,114 filed Dec. 21, 1983, now abandoned.

BACKGROUND OF THE INVENTION

A. Field of the Invention

This invention relates to carpets having a pile consisting essentially of polyamide fibers which are stain resistant and a primary backing which is substantially impervious to water.

The term fiber as used herein includes fibers of extreme or indefinite length (i.e., filaments) and fibers of short length (i.e., staple). The term yarn as used herein means a continuous strand of fibers.

The term stain resistant as used herein with reference to carpet or fiber means carpet or fiber having the ability to resist staining when subjected to an aqueous solution containing Food Drug and Cosmetics (FD&C) Red Dye No. 40.

B. Description of the Prior Art

The typical carpet for residential applications is a wall-to-wall carpet comprising a primary backing material, such as polypropylene or jute, stitched with closely spaced erect loops or cut loops of polyamide yarn which extend upwardly from the backing to form a tufted structure (i.e., pile). The underside of the primary backing is coated with an adhesive composition. The adhesive anchors the tufts in the primary backing and is applied to the backing in the form of a latex compounded emulsion which is then dried with heat to cure the adhesive. In most instances, a secondary backing is applied to the underside of the primary backing before the adhesive is dried and cured. The typical carpet is normally installed with an underpad being placed between the carpet and floor. The underpad enhances the cushioning effect and wear-life of the carpet. The carpet and underpad are referred to herein as the carpet system.

Unfortunately, liquids such as water and water based substances (e.g., beverages, medicines, urine), which spill or otherwise come into contact with the pile of the typical carpet system give rise to one or more problem(s). One problem caused by the liquid is that the liquid penetrates the components of the carpet system (i.e. backings, adhesive layer and underpad) and is absorbed by each along the way. The absorbed liquid is not easily removed by conventional household techniques, such as by the use of towels, sponges and vacuum cleaners, and becomes trapped in the components of the carpet system. In the case of water, the trapped liquid causes mildew and rot of the carpet system and wooden floors. In the case of urine, the trapped liquid also gives rise to a prolonged, offensive odor.

Another problem caused by the liquid is that, even after the surface liquid is initially removed from the pile, liquid trapped in the backings, adhesive layer and underpad wicks through the pile fibers and rewets the pile, a phenomenon referred to as rewicking. The drying-/rewicking of the pile often continues over an extended period of time and can cause embarrassment and inconvenience depending on the circumstances.

Still another problem caused by the liquid is that the pile fibers of the typical carpet system are permanently stained by certain colorants present in liquids, such as those present in coffee, red wines, soft drinks and urine.

Of course, it is difficult to wash stains or odors from the pile without also wetting the underpad. Additionally, if the staining liquid is not immediately removed, the rewicking (i.e. restaining) phenomenon becomes even a more severe problem.

SUMMARY OF THE INVENTION

The present invention provides a carpet comprising a primary backing and a pile consisting essentially of fibers attached to said primary backing, wherein the fibers are stain resistant and the primary backing is substantially impervious to liquids and, specifically, to water.

The carpet of the present invention eliminates the above-mentioned problems associated with corresponding prior art carpets. An important feature of the carpet of the invention is that it is both stain resistant and impervious to liquids. For example, if the carpet were impervious to liquids but not stain resistant, a staining liquid coming into contact with the carpet would spread out over a greater area of carpet and stain the carpet to a greater extent than if the backing were not impervious to liquids. On the other hand, if the carpet were stain resistant but not impervious to liquids, it would be difficult to effectively wash a staining liquid from the carpet without wetting the underpad. Also, since the carpet of the invention is impervious to liquids, urine which often comes into contact with carpet in households frequented by infants and house pets cannot penetrate and be absorbed and stored in the components of the carpet system.

PREFERRED EMBODIMENTS OF THE INVENTION

The carpet of the invention comprises stain resistant polyamide pile fibers and a primary backing which is substantially impervious to liquids and, specifically, to water. The fibers may be attached to the primary backing by conventional means, e.g. stitching, glueing, etc. Typically, the fibers in the form of plied yarns are stitched into the primary backing and cut to provide cut pile tufted carpets.

According to a preferred embodiment of the invention the carpet is a cut pile tufted carpet and is made in a conventional manner using commercially available materials, namely, nylon 66 or nylon 6 fibers in the form of a two-ply, staple or continuous filament carpet yarn, jute or polypropylene backing materials and a conventional carpet backing adhesive composition with the exception that (1) the adhesive composition contains a fluorochemical in an amount sufficient to render the backing impervious and (2) the fibers are treated either before or after tufting to render the carpet stain resistant.

Adhesive compositions which may be used in providing the carpet of the present invention comprise a mixture of a latex of a synthetic polymer known to be usable for binding tufts of fiber in carpet primary backings, filler (e.g. $CaCO_3$) and other additives (e.g. thickeners, fungicides, etc.). Such polymers are capable of being prepared in uniform aqueous colloidal dispersions have spherical particles averaging 0.2 microns in diameter and include, but are not limited to, polyvinyl acetates, polyacrylates, polyethylenevinylacetate copolymer, styrene-butadiene copolymers (SBR) and/or carboxy styrene-butadiene copolymers.

Fluorochemicals which may be added to the adhesive composition in accordance with the present invention are commerically available and include those available from Minnesota Mining and Manufacturing Company under the tradename Scotchgard®, such as Scotchgard 352. It has been found that the amount of a particular fluorochemical required to provide a primary backing that is impervious to water will depend on the particular fluorochemical and adhesive composition selected. In general, from 0.1 to 1.0% by weight of the fluorochemical, based on weight of adhesive composition is sufficient with amounts in the range of 0.2 to 0.4% by weight usually being sufficient. Preferably, as little as possible of the fluorochemical is used in order to minimize the overall cost of the carpet. Instead of rendering the backing impervious to water by adding an effective amount of fluorochemical to the adhesive composition, it is contemplated that other means could be used to accomplish an equivalent result, for example, coating the backing with a water-impervious film such as an ethylene-vinylacetate copolymeric film.

Preferably, the fibers are rendered stain resistant by treating the fibers, either before or after tufting, with an effective amount of a sulfonated phenol-formaldehyde or naphthol-formaldehyde condensation product. By an effective amount is meant an amount sufficient to provide stain resistant fiber. Typically, such an amount is an amount in excess of 0.1% by weight, based on the weight of fiber (c.w.f.), with amounts ranging from 0.2 to 1.5% usually being sufficient. At higher concentrations the fibers tend to become stiff. By sulfonated phenol-formaldehyde and napthol-formaldehyde condensation product is meant that the product contains sulfonic acid groups (i.e., $—SO_3H$) or a salt thereof (e.g., alkali metal salt) attached to carbon atoms of the phenolic or naphtholic groups. Preferably, the fibers are treated with the condensation product by applying the condensation product to the fibers from an aqueous medium. According to one embodiment, the medium is an aqueous spin finish and is applied to the fibers during melt spinning of the fibers while the fibers are in the form of continuous filament yarn. In this embodiment, the yarn after it is quenched is passed over a freely rotating roll (finish roll) partially immersed in the spin finish. The yarn is then subjected to conditions of time and temperature sufficient to dry the yarn before it is collected. Normally, when the condensation product is applied to the yarn from a spin finish during preparation of the yarn, no extra heating steps are required to dry the yarn. The resulting yarn then can be processed into continuous filament yarn or staple yarn. According to one embodiment of the invention the treated fibers in yarn form are further treated under conditions of time and temperature sufficient to assure and/or improve fixation of the condensation product to the fibers but without degrading or otherwise damaging the fibers, such as a temperature ranging from about 100 C. to 225 C. Normally, such conditions are encountered by the fibers during conventional carpet yarn heatsetting operations where the yarns are subjected to steam (135° C.) or dry air (200° C.).

According to another embodiment of the invention, the fibers are rendered stain resistant after tufting by immersing the resulting carpet in an aqueous medium containing the condensation product. The medium is preferably at a pH of 4.5 or less, at a temperature ranging from 90° C. to the boiling temperature of the medium. The weight ratio of aqueous medium to pile fiber should be no greater than about 40:1 in order to provide pick up of the condensation product by the fiber at a reasonable rate. If desired, the carpet may be treated during dyeing (e.g., beck dyeing) by adding appropriate amounts of the condensation product to the beck dye bath and then conducting the dyeing of the carpet at the conditions specified above.

Preferred sulfonated condensation products for use in providing the carpet fabric of the invention are linear, low molecular weight condensation products, that is, products having an average molecular weight of less than about 1000, for example, in the range of 250 to 700. Such products are water-soluble and commercially available from Crompton and Knowles under the tradename Intratex®N and from Ciba-Geigy under the tradenames Erional®PA and Erional NW or may be prepared by conventional art-recognized techniques, for example, condensation of phenolsulfonic acid, formaldehyde and phenol in a mole ratio of phenols/formaldehyde (P/F) of about 1.0/0.8 at a pH of less than 7 using an acid catalyst such as HCl. High molecular weight, crosslinked products can be prepared by using a P/F ratio of less than 1, e.g. 1.0/1.5. Alternatively, phenol and formaldehyde can be treated in an appropriate mole ratio to provide a condensation product that is subsequently sulfonated by treatment with fuming sulfuric acid.

As a practical matter, condensation products useful for practicing of the present invention are those prepared from relatively inexpensive, commercially available monomers such as phenol, diphenolsulfone, formaldehyde and ortho- and para-phenolsulfonic acids or salts thereof and mono- and disulfonated diphenolsulfones or salts thereof. Examples of such salts include the sodium, potassium or lithium salts thereof. However, it is contemplated that other monomers instead of or in addition to the foregoing monomers may be used to achieve equivalent results without departing from the scope and spirit of the invention. Such other monomers include, for example, a substituted phenol (e.g. a methyl substituted phenol) or another aldehyde such as furfuraldehyde, benzaldehyde, etc. Also, instead of the sulfonic acid groups or salt thereof being attached directly to the phenolic or naphtholic group of the condensation product, the groups may be attached through a linking group such as a methylene group.

Any polyamide may be used in providing the carpet fabric of the present invention. Polyamide fibers of major commercial importance for use in making carpet pile fabric are those shaped from nylon and, especially, those shaped from nylon 66 (i.e. polyhexamethylene adipamide) and those shaped from nylon 6 (i.e. polycaprolactam). Other polyamides from which the fibers may be shaped include: nylon 11 which is the polymer of 11-amino undecanoic acid; nylon 610 which is polyhexamethylene sebacamide; and copolymers of nylon 66 or nylon 6 in which a portion of the nylon 66 or nylon 6 monomers are replaced by other monomers copolymerizable therewith, for example, a nylon 66/6 copolymer or nylon 66/6TA copolymer where 6TA is hexamethylene terephthalamide.

EXAMPLE

This example illustrates the preparation of carpet of the present invention and compares the carpet to conventional carpet.

A 310 filament, 60 denier per filament (dpf), undrawn nylon 66 yarn was prepared by conventional procedures. Fifty-four (54) such yarns were combined to form a tow having a total denier of about 1,000,000. The tow was drawn over rolls to provide nominal 18 dfp tow, crimped in a conventional stuffer box and cut into 7½ inch (19.05 cm) staple. The staple was carded, drafted and spun on a conventional ring spinning frame to provide a 2½ cotton count yarn having about 4.5 tpi (177 tpm) of twist in the Z-direction. Two of these yarns were plied on a conventional ring twister to provide a plied yarn having a net twist of 0 tpi in the Z-direction and 3 tpi (118 tpm) in the S-direction. The resulting plied yarn was then heatset. Cut pile carpet was made by tufting the heatset plied staple yarn into a polypropylene primary backing in a conventional manner. The carpet was then dyed to a light gold color in a conventional beck dyeing operation in which the carpet was immersed in an aqueous dye bath contained within a vessel. The bath contained a sulfonated phenolformaldehyde condensation product (Erional NW) in an amount sufficient to provide 0.4% by weight of condensation product on weight of carpet pile fabric and was maintained at a pH of 4.5 and at the boiling temperature of the bath (liquor). The weight ratio of liquor to carpet fiber was 20:1. Light gold was selected as being a color which contrasts well with most stains. The carpet backing adhesive composition used in making the carpet was a carboxy styrene-butadiene latex obtained commercially from Textile Rubber and Chemical Company under the designation L-1254 to which had been added with stirring 0.25% by weight, based on the weight of the latex, of a fluorochemical obtained commercially from Minnesota Mining and Manufacturing Company under the tradename Scotchgard ®352. The resulting latex was applied to the primary backing of the carpet in a conventional manner in an amount of 25–60 oz./yd$^2$ of carpet and then a secondary backing was applied to the primary backing before the adhesive was dried and cured.

One gallon (3785 ml) of an aqueous solution of a commercially available soft drink premix was poured onto a sample of the above-identified carpet (invention) and allowed to stand for 60 hours before cleaning. The solution was prepared according to the instruction on the premix package. The premix ingredients included FD&C Red Dye No. 40. The concentration of this dye in the solution was 0.054 gms/liter. After the 60-hour period, the soft drink was removed from the carpet using a rented carpet cleaning unit which utilized a detergent containing hot water. The resulting carpet sample (invention) was not stained by the drink and substantially none of the drink penetrated the backing during the 60-hour period.

For purposes of comparison a commercially available carpet (control) similar in construction to the above test carpet and having a pile tufted from nylon 66 bulked continuous filament yarn was purchased. A sample of carpet was tested in the manner described above except in this instance the soft drink was allowed to stand on the carpet a period of only 30 minutes before being removed from the carpet by the rented commercial cleaning unit. In this instance the carpet sample (control) was permanently stained by the soft drink and a considerable amount of the drink had penetrated the backing.

In related experiments, a gallon (3785 ml) of the same soft drink described above was poured onto an additional sample of each carpet and allowed to stand for 60 hours. Only 90 ml or about 2.5% of the drink had passed throug the backings of the test carpet (invention), whereas about 2000 ml or more than 50% of the drink had passed through the backings of the control carpet.

In other tests, test carpet samples (invention) prepared as described above were subjected to floor testing in which the samples were placed in an area where human traffic was heavy and left until each was subjected to 50,000 traffics, a traffic occurring each time a human walks across the carpet. All the samples were badly soiled. Some of the samples were cleaned with commercial equipment of the type described above, others were washed in a household washing machine, and still others were washed with generous amounts of water and detergent. The restorability of the samples washed in the washing machine and with generous amounts of water and detergent was excellent, whereas the samples cleaned with the commercial equipment did not approach the restorability of the other samples. Of course, wall-to-wall carpet cannot easily be cleaned in a washing machine. However, because the test carpet samples possessed a primary backing substantially impervious to water, a sufficient amount of water could be used in washing the samples to restore the samples to like-new condition without fear of the water penetrating the backing and being absorbed by the underpad.

We claim:

1. A carpet comprising a primary backing stitched with closely spaced loops or cut loops of nylon 6 or nylon 66 yarn which extend upwardly from the top surface of the primary backing to form a pile, wherein the underside of the primary backing is coated with a carpet backing adhesive composition, characterized in that said yarn is coated with a sufficient amount of a sulfonated phenol- or naphthol-formaldehyde condensation product to render the carpet stain resistant and said adhesive composition contains a fluorochemical in an amount sufficient to render said primary backing substantially impervious to water.

2. The carpet of claim 1 wherein said fibers are nylon 66 fibers.

3. The carpet of claim 1 wherein the carpet includes a secondary backing.

4. The carpet of claim 1, wherein said adhesive composition includes a carboxy styrene-butadiene latex.

* * * * *